US005907741A

United States Patent [19]

Matsuzawa et al.

[11] Patent Number: 5,907,741

[45] Date of Patent: May 25, 1999

[54] IMAGE FORMING APPARATUS

[75] Inventors: Kunihiko Matsuzawa, Kawasaki; Kou Hirai, Numazu, both of Japan

[73] Assignee: Canon Kabushiki Kaisha, Tokyo, Japan

[21] Appl. No.: 08/902,978

[22] Filed: Jul. 30, 1997

[30] Foreign Application Priority Data

Jul. 31, 1996 [JP] Japan ..... 8-217932

[51] Int. Cl.[6] ..... G03G 15/01; G03G 21/00

[52] U.S. Cl. ..... 399/44; 399/94; 399/299

[58] Field of Search ..... 399/299, 306, 399/397, 66, 68, 94, 44

[56] References Cited

U.S. PATENT DOCUMENTS 4,660,077 4/1987 Kawamura et al. .

4,816,844 3/1989 Uchida et al. ..... 346/160

5,170,215 12/1992 Pfeuffer .

5,561,512 10/1996 Fukano et al. .

*Primary Examiner*—Richard Moses

*Attorney, Agent, or Firm*—Fitzpatrick, Cella, Harper & Scinto

[57] ABSTRACT

The present invention provides an image forming apparatus comprising a recording material bearing member for bearing and conveying a recording material, an image forming means for forming an image on the recording material born on the recording material bewaring member, and a drive rotary member for driving the recording material bearing member to convey the recording material by means of the recording material bearing member. A rotational speed of the drive rotary member is controlled in accordance with information regarding a temperature of the image forming apparatus.

24 Claims, 6 Drawing Sheets

IMAGE FORMING APPARATUS

BACKGROUND OF THE INVENTION

1. Field of the Invention

The present invention relates to an image forming apparatus such as a printer, a facsimile, a copying machine and the like, using an electrophotographic system, an ink jet system or a heat transfer system.

2. Related Background Art

In conventional image forming apparatuses in which an image is formed with the above-mentioned system while a recording medium such as a recording sheet is being conveyed, the following arrangement is generally known.

An apparatus shown in FIG. 6 includes an image input portion 90R and an image output portion 90P. The image input portion 90R serves to receive image information for the recording and to output an image signal to the image output portion 90P after the image information was subjected to various treatments. The image output portion 90P comprises an image forming portion 91 for forming an image, a sheet supply unit 92 for containing stacked recording sheets P and for supplying the recording sheets one by one, a transfer convey unit 93 for convey the recording sheet P supplied from the sheet supply unit 92 to the image forming portion 91 and for transferring the image onto the recording sheet, a fixing unit 94 for fixing the image recorded on the recording sheet, and a control unit 95 for controlling the entire operation of the apparatus.

Now, a recording operation will be described in order. When the operation of the apparatus is started, first of all, the recording sheet P is supplied from the sheet supply unit 92 and is sent to a pair of regist rollers 96 (now stopped) disposed in front of the convey unit 93. Thereafter, in synchronous with an image record start signal, the regist rollers 96 are rotated to seat the recording sheet P onto the convey unit 93. With this operation, an image can be formed at a predetermined position on the recording sheet.

The recording sheet P sent from the pair of regist rollers 96 is conveyed to an image transfer area T while being held on the convey unit 93. At the image transfer area T, the image from the image forming portion 91 is transferred onto the recording sheet. The holding of the recording sheet P on the convey unit 93 is generally accomplished by electrostatically absorbing the recording sheet onto a convey belt of the convey unit formed from a thin dielectric film. After the image was formed on the recording sheet P, the convey unit 93 conveys the recording sheet P to a position proximity to a fixing unit 94, and then sends the recording sheet to the fixing unit 94 while separating a tip end of the recording sheet. The recording sheet is subjected to heat (and pressure) from a fixing nip of the fixing unit 94, to thereby fix the toner image to the recording sheet. Thereafter, the recording sheet P is discharged out of the apparatus through a discharge portion.

Further, in an image forming apparatus having a plurality of image forming portions 91*a*, 91*b*, 91*c* and 91*d* as shown in FIG. 7, images formed in the image forming portions 91*a* to 91*d* by the image forming process substantially the same as described above are transferred onto the recording sheet P in a superimposed fashion at respective image transfer areas Ta, Tb, Tc and Td.

A convey drive roller 97 of the convey unit 93 is generally disposed at a downstream side of and in the vicinity of the last image transfer area. The reason is that, when the convey drive roller is disposed at the downstream side of the image transfer areas (Ta to Td), the convey belt is pulled toward a conveying direction at each image transfer area, to thereby prevent the poor image transferring and the transfer positional deviation. Further, in order to make the apparatus compact, a distance between the convey unit 93 and the fixing unit 94 should be reduced as much as possible. To this end, the convey drive roller 97 should be disposed in the vicinity of the fixing unit 94.

However, in the above-mentioned image forming apparatus, the following problems will arise.

When the power source of the apparatus is turned ON, a heater of the fixing unit 94 is automatically operated to heat the fixing unit to a predetermined temperature. A part of the heat leaks out of the fixing unit, so that the temperature of the interior of the apparatus is increased to some extent. Particularly, since the convey drive roller 97 of the convey unit 93 is disposed in the vicinity of the fixing unit 94, the temperature increase of the convey drive roller becomes greater than those of the other elements. As a result, the convey drive roller 97 is expanded to change a convey speed of the convey belt of the convey unit 93. If the change in speed of the convey belt exceeds a certain value, contraction of the transferred image will occur.

Further, in the apparatus in which the different images formed in the plurality of image forming portions are successively transferred onto the same recording sheet in a superimposed fashion as shown in FIG. 7, positional deviation between the transferred images (transfer deviation) will occur. Particularly, in the latter case, the transfer deviation occurs even when the speed is changed by 0.1% or more, depending upon a path length between the image forming portions.

In order to drive the belt of the convey unit 93 without slip, the convey drive roller 97 has generally an outer layer having high coefficient of friction (for example, rubber layer). However, in general, since such material has a great coefficient of linear expansion, the expansion of the rubber layer cannot be negligible for the image deviation. More specifically, if the temperature of the roller is increased by about 20° C., a diameter of the roller will be increased by about 0.1%, and, in other words, the convey speed will be increased by about 0.1%. Further, the apparatus itself is expanded due to the increased interior temperature to increase the distance between the image forming portions, which results in the transfer deviation.

In order to solve the above problems, there has been proposed a technique in which thermal insulating material is arranged around the fixing unit to prevent heat from leaking from the fixing unit as much as possible. However, since the inlet and outlet for the recording material cannot be covered by the heat insulating material, the heat cannot be prevented from leaking through the entrance and the outlet. Further, in consideration of the cost and space for the heat insulating material, such proposal is not said to be a best solution.

Further, it is considered that the fixing heater is de-energized when the apparatus is not operated to minimize the operation of the fixing heater. In this case, however, whenever the apparatus is operated, the fixing temperature must be increased to the predetermined fixing allowable temperature (meanwhile, the operator is merely waiting to reach the stand-by condition), to thereby worsen the operability.

SUMMARY OF THE INVENTION

An object of the present invention is to provide an image forming apparatus which can prevent expansion/contraction of a transferred image and occurrence of a transfer deviation with less space and less cost and with a simple construction, regardless of a temperature of the interior of the apparatus.

The other objects and features of the present invention will be apparent from the following detailed explanation referring to the accompanying drawings.

DETAILED DESCRIPTION OF THE PREFERRED EMBODIMENTS

The present invention will now be explained in connection with embodiments thereof with reference to the accompanying drawings.

First Embodiment

A first embodiment of the present invention will be fully described with reference to FIGS. 1 to 4. Hereinbelow, as an image forming apparatus of the present invention, a color image forming apparatus of electrophotographic type in which a plurality of image forming portions are disposed side by side and which is considered to be most effective to the present invention will be explained.

Figure 1:
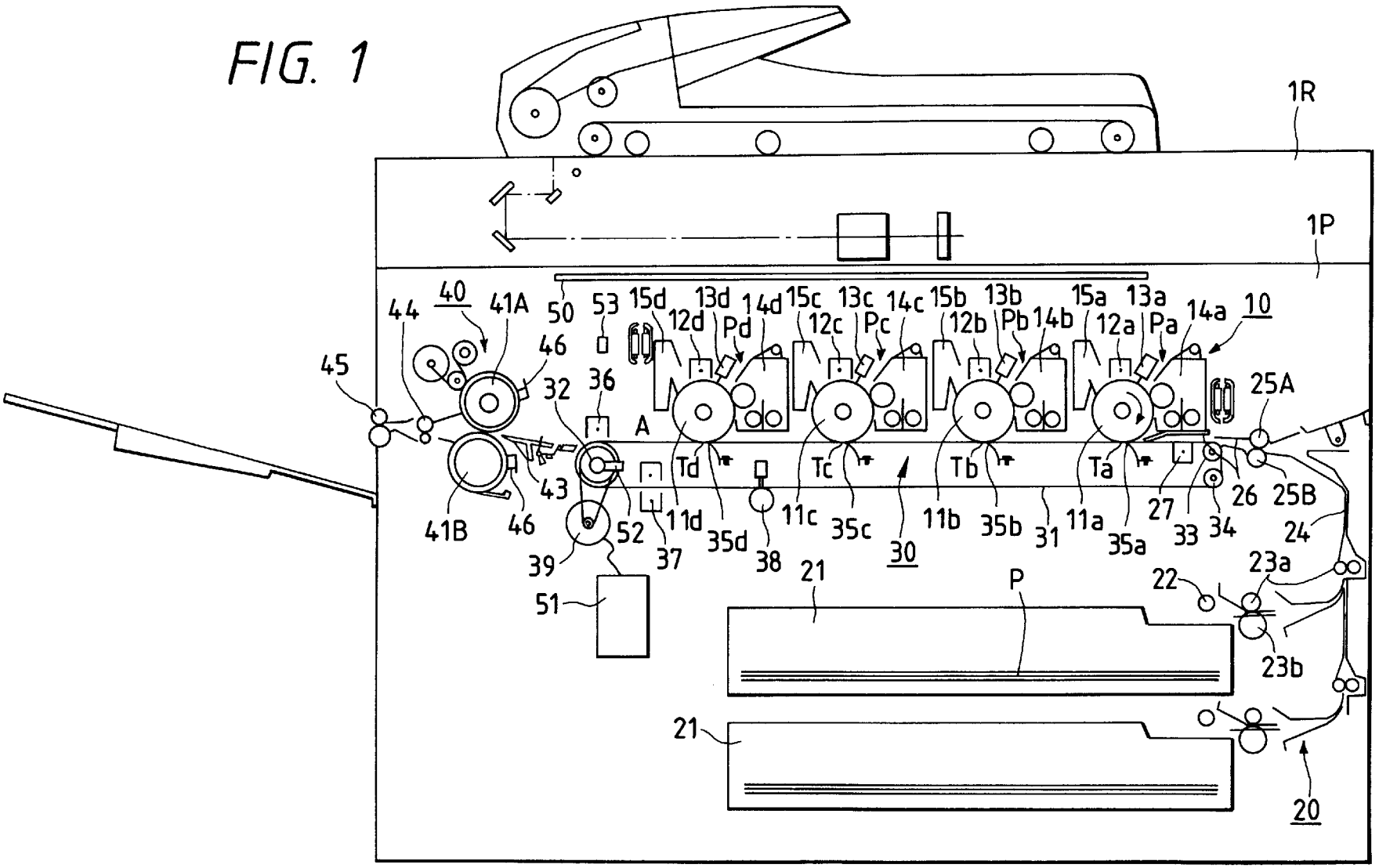
FIG. 1 is a sectional elevational view of an image forming apparatus according to a first embodiment of the present invention.

An image forming apparatus shown in FIG. 1 includes an image input portion 1R and an image output portion 1P, and the image output portion 1P comprises an image forming portion 10 (including four stations Pa, Pb, Pc and Pd disposed side by side, the stations having the same construction), a sheet supply unit 20, a transfer convey unit 30, a fixing unit 40, and a control unit (not shown).

The image forming portion 10 is constructed as follows. Regarding the stations therein, a station Pa will be described as an example. A photosensitive drum (image bearing member) 11*a* is rotated around its central axis in a direction shown by the arrow. Around the photosensitive drum 11*a*, there are disposed a first charger 12*a*, an optical system 13*a* and a developing device 14*a* along a rotational direction of the drum.

The surface of the photosensitive drum 11*a* is uniformly charged by the first charger 12*a*. Then, the photosensitive drum 11*a* is exposed by a light beam (laser beam modulated in accordance with a record image signal) from the optical system 13*a*, to thereby form an electrostatic latent image on the drum.

Then, the electrostatic latent image is visualized by the developing device 14*a*. In the illustrated apparatus, the developing devices 14*a* to 14*d* contain therein yellow color developer, magenta color developer, cyan color developer and black color developer (referred to as "toner" hereinafter), respectively, and are disposed in the vicinity of the respective photosensitive drums 11*a* to 11*d* at the respective stations Pa to Pd.

Residual toner remaining on the photosensitive drum 11*a* (not transferred to the recording sheet P) is removed by a cleaning device 15*a* disposed at a downstream side of the photosensitive drum 11*a* at an image transfer area Ta, to thereby clean the surface of the photosensitive drum. By the above-mentioned process, various color toner images are successively formed at the stations Pb, Pc and Pd.

The sheet supply unit 20 includes a cassette 21 containing the recording sheets P, a pick-up roller 22 for feeding out the recording sheets from the cassette one by one, sheet feed rollers 23*a*, 23*b* and a sheet supply guide 24 for conveying the recording sheet P fed out from the pick-up roller 22 to a pair of regist rollers 25A, 25B, the pair of regist rollers 25A, 25B for feeding the recording sheet P to the transfer convey unit 30 in a timed relation to the image formation at the image forming portion, and absorption guides 26 for directing the recording sheet P to the transfer convey unit 30.

Now, the transfer convey unit 30 will be fully described. A transfer belt 31 is constituted by a recording sheet holding sheet (dielectric sheet) 31 (made of PET (polyethylene terephthalate) or PVdF (polyvinylidence fluoride)) wound around and mounted on a plurality of rollers (belt drive roller 32, driven roller 33 and tension roller 34). An image transfer plane A is defined between the belt drive roller 32 and the driven roller 33. More specifically, the transfer belt is spaced apart from the photosensitive drums with a small gap (about 1 mm).

The belt drive roller 32 is constituted by a metallic roller and a thin rubber (urethane or chloroprene) layer having a thickness of several millimeters and coated on the metallic roller to prevent slip between the roller and the belt. The belt drive roller 32 is driven by a pulse motor 39. As will be described later, the rotational speed of the belt drive roller can easily be altered. The tension roller 34 serves to apply proper tension to the holding sheet 31 (referred to as "transfer belt" hereinafter).

An absorption charger 27 is disposed at a position where the recording sheet P fed from the pair of regist rollers 25A, 25B enters onto the transfer belt 31, and, at the image transfer areas Ta to Td where the photosensitive drums 11*a* to 11*d* are opposed to the transfer belt 31, transfer charge blades 35*a*, 35*b*, 35*c* and 35*d* are disposed below an under surface of the transfer belt 31. The transfer charge blades 35*a* to 35*d* can be urged against and separated from the respective photosensitive drums 11*a* to 11*d* by respective pressurizing mechanisms (not shown). When pressurized, the corresponding transfer charge blade lifts the transfer belt 31 to urge the transfer belt against the corresponding photosensitive drum 11*a* (11*b*, 11*c* or 11*d*) with proper pressure, to thereby permit the good image transferring.

A separation electricity removal charger 36 for separating the recording sheet is disposed immediately at an upstream side of the belt drive roller 32, and an electricity removal charger 37 for applying uniform charge to the surface of the transfer belt 31 and a brush roller 38 for cleaning the recording holding surface of the transfer belt 31 are disposed at a downstream side of the charger 36.

The fixing unit 40 includes a fixing roller 41A having a heat source (for example, a halogen heater) therein, a pressure roller 41B urged against the fixing roller (the pressure roller may include therein a heat source), an inlet guide member 43 for directing the recording sheet to a nip between the fixing roller and the pressure roller, and pairs of inner and outer discharge rollers 44, 45 for discharging the recording sheet sent from the nip out of the apparatus. A distance between the fixing roller 41A and the belt drive roller 32 is selected to about 100 mm or less.

The control unit includes a control substrate 50 for controlling the mechanism in the units and a motor drive substrate 51.

Next, the operation of the apparatus will be described. When the image formation start signal is emitted, the recording sheet P is fed from the cassette 21 by means of the pick-up roller 22. The recording sheet is guided through the sheet feed guide 24 and is conveyed to the pair of regist rollers 25A, 25B by means of the feed rollers 23*a* and 23*b*. (In this case, the pair of regist rollers 25A, 25B are stopped. Thus, a tip end of the recording sheet abuts against a nip between the stopped regist rollers). Thereafter, the pair of regist rollers 25A, 25B start to rotate in synchronous with the image formation in the image forming portion. The timing of start of rotation of the regist roller pair is selected so that the tip end of the recording sheet is aligned with a tip end of the toner image formed on the photosensitive drum.

When the recording sheet P enters onto and is contacted with the transfer belt 31 shifted by the belt drive roller 32, the recording sheet is electrostatically absorbed to the transfer belt by a Coulomb's force generated on the transfer belt 31 by the action of the absorption charger 27. Since the transfer belt 31 is being rotated in synchronous with the photosensitive drums 11*a* to 11*d*, the recording sheet P is conveyed to the first image transfer area Ta while being held on the transfer belt. At the first image transfer area Ta, high voltage is applied to the pressurized transfer charge blade 35*a* at a timing of passage of the transfer sheet P.

The toner image formed on the photosensitive drum 11*a* by the above-mentioned process is transferred onto the surface of the recording sheet P. Thereafter, the recording sheet is conveyed to the next image transfer area Tb. At this transfer area Tb, the image was formed on the photosensitive drum 11*b* with a delay corresponding to the time required to convey the recording sheet from the area Ta to the area Tb. Thus, at the transfer area Tb, the image is transferred onto the recording sheet to which the toner image was already transferred in a superimposed fashion. At the subsequent image transfer areas Tc and Td, the same process are repeated, so that the four color toner images are transferred onto the recording sheet in a superimposed fashion.

After the four color toner images were transferred to the recording sheet in the superimposed fashion, the absorbing force between the recording sheet and the transfer belt is reduced by the action of the electricity removal charger 36 at the separation portion, and, thereafter, the recording sheet is separated from the transfer belt 31 by change of curvature of radius of the transfer belt at the belt drive roller 32. The recording sheet separated from the transfer belt 31 is correctly guided to the nip between the fixing roller and the pressure roller through the inlet guide 43. Then, the toner images are fixed to the recording sheet by heat and pressure from the pair of rollers 41A, 41B.

Thereafter, the recording sheet is conveyed by the pairs of inner and outer discharge rollers 44 and 45 to be discharged out of the apparatus. The transfer blades 35(*a*)–35(*d*) are de-pressurized to separate the transfer belt 31 from the photosensitive drums. Thus, external pressure acting on the photosensitive drums is reduced, to thereby protect the photosensitive drums.

Next, the characteristics of the illustrated embodiment of the present invention will be described.

An environment detection sensor 53 for measuring temperature and humidity of the interior of the apparatus is disposed within the apparatus. Data from the environment detection sensor 53 is inputted to the control substrate 50, and the data is fed-back to the charge amounts on the photosensitive drums 11(*a*)–11(*d*) (applied by the first chargers 12(*a*)–12(*d*) at the image forming portion) and the developing conditions of the developing devices 14(*a*)–14(*d*). In this way, the optimum image can always be obtained under every environmental conditions.

Figure 2:
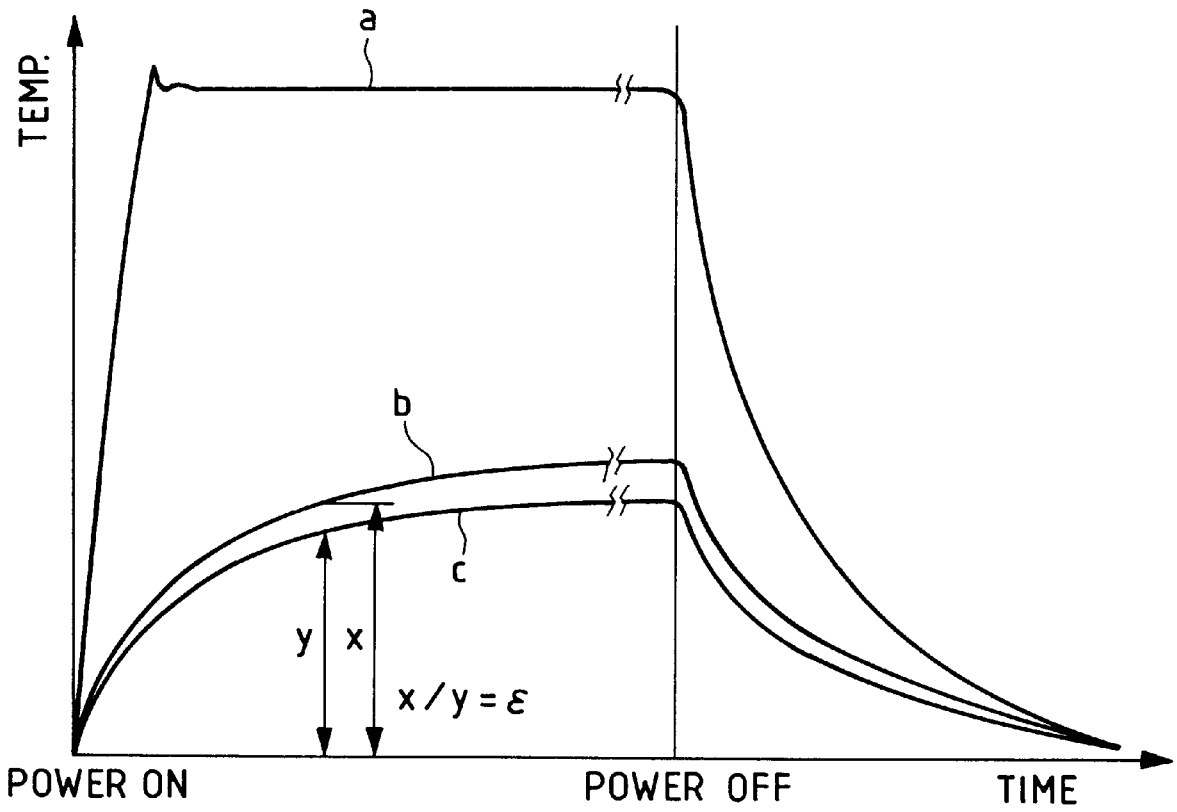
FIG. 2 is a graph showing change in temperatures of elements in the apparatus for explaining the first embodiment.

The change in temperatures of various elements in the apparatus from power ON is shown in FIG. 2 (graph). In FIG. 2, "a" is a temperature in the fixing unit, "b" is a temperature of the belt drive roller 32, and "c" is output of the environment detection sensor 53. The abscissa indicates a time elapsed. A relation between "a" and "b" has substantially constant ratio $\epsilon$ (=x/y) through the entire time range (or, the sensor is disposed so that such a relation can be maintained as much as possible). Accordingly, by previously determining the above ratio $\epsilon$, the temperature of the belt drive roller can be guessed from the input data of the environment detection sensor, and, thus, the amounts of expansion of rollers can be calculated.

The frequency pulse calculated on the basis of the output from the environment detection sensor 53 is inputted to the motor driver substrate 51, to thereby control the pulse motor 39. In this way, it is possible to always keep the speed of the transfer belt constant. More specifically, the number of revolutions of the belt drive roller at a given temperature is previously set and the coefficient of linear expansion of this roller is previously inputted, for example, at a time when the roller is manufactured at a factory. In this case, there is no expansion/contraction of the image and the transfer deviation.

In use, if the environmental temperature differs from the set temperature, the diameter of the belt drive roller will slightly differ from the set diameter. Further, when a long time is elapsed from power ON of the apparatus, since the heat is gradually dispersed from the fixing unit 40, the internal temperature of the apparatus is increased, and the diameter of the belt drive roller is also increased accordingly due to the thermal expansion. However, since the internal temperature is monitored by the environment detection sensor 53 and the coefficient of linear expansion of the belt drive roller is already known, the increase in diameter of the roller corresponding to the increase in temperature can be calculated from the sensor signal, and, thus, the increase in speed of the transfer belt can be guessed. Therefore, the number of revolutions of the motor can be adjusted (decreased) on the basis of the guessed data. In this way, even when the diameter of the roller is changed, it is possible to keep the speed of the belt constant.

Figure 3:
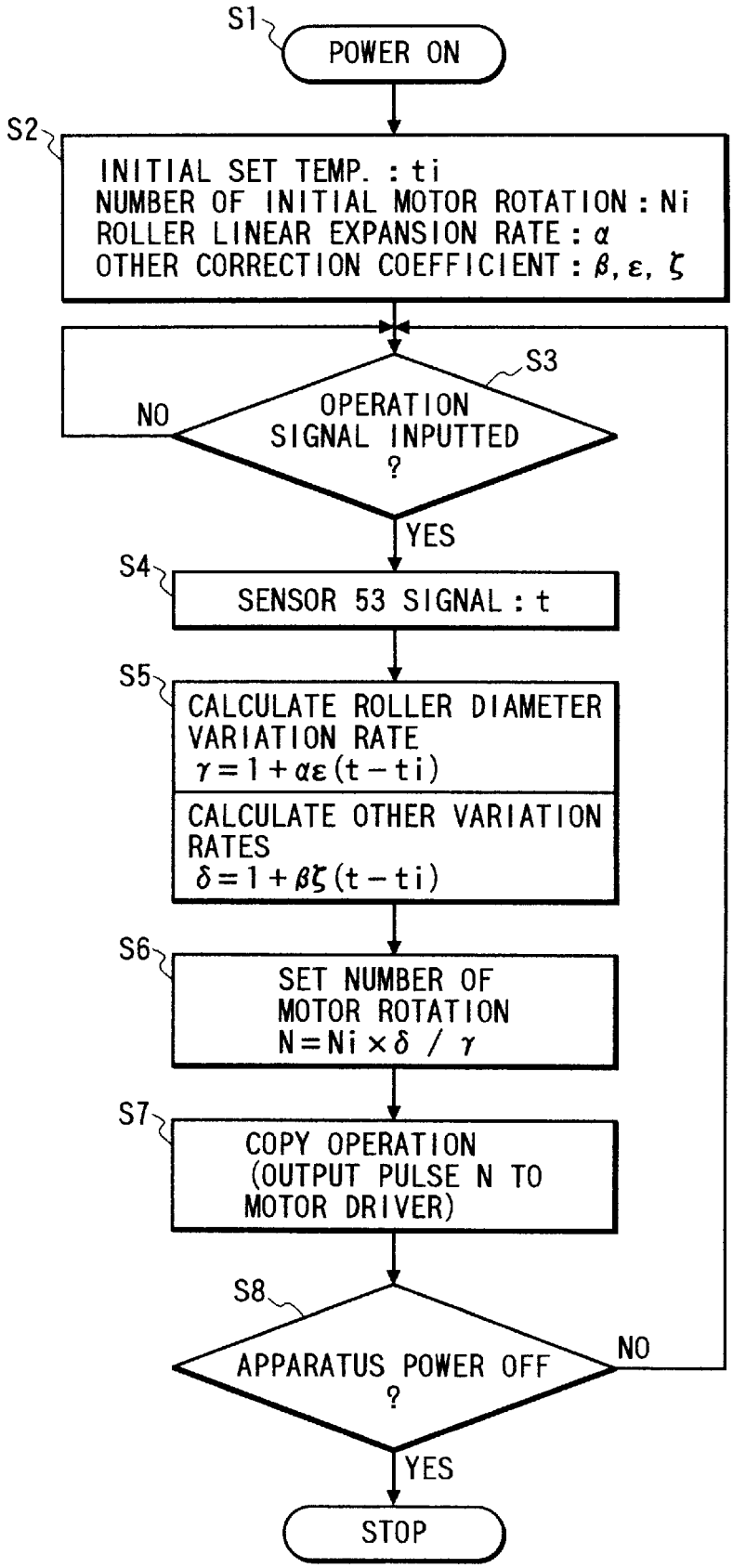
FIG. 3 is a flow chart showing an operation of the apparatus according to the first embodiment.

The flow chart shown in FIG. 3 shows the above-mentioned operation of the apparatus.

After power ON (step S1), initial set values and physical values are read out from ROM (step S2). The initial set values include the initial set temperature $t_i$, and the number of initial motor rotation $N_i$, and the physical values include the coefficient of linear expansion of the roller $\alpha$ and other correction coefficients $\beta$, $\epsilon$, $\zeta$.

Then, when the operation signal is inputted (step S3), the detected temperature t of the environment detection sensor 53 is checked (step S4). Then, on the basis of the data from the sensor, the roller diameter change (variation) ratio $\gamma$ ($=1+\alpha\epsilon(t-t_i)$) and other variation ratios $\delta$ ($=1+\beta\zeta(t-t_i)$) are calculated (step S5), and the number of revolutions of the motor N ($=N_i\times\delta/\gamma$) is determined on the basis of the calculated values (step S6). Thereafter, the apparatus is operated to output the determined drive pulse to the motor driver 51

(step S7). Then, the apparatus is turned OFF (power OFF) or the program is returned to the step S3 (step S8).

Now, the correction coefficient β will be described. Among factors changed by the increase in the internal temperature, one of the factors which affect an influence upon the transferred image is a pitch between the image forming stations (distance between the transfer positions). The image forming stations must be positioned relative to each other with high accuracy. To this end, the image forming stations are positioned with respect to a common member (for example, secured to front and rear side plates of the apparatus, or secured to a common positioning plate provided in the apparatus).

In this case, when the temperature of the common member is increased to expand the same, the pitch between the stations is increased to thereby cause the transfer deviation. To avoid this, the increase in pitch is cancelled by increasing the speed of the transfer belt. Thus, the value β is a coefficient of linear expansion of the common positioning member. Incidentally, when the detection temperature of the environment detection sensor 53 does not indicate the temperature of the positioning member directly, the temperature correction coefficient ζ corresponding to the ratio ϵ may be previously determined.

It should be noted that, when the increase in pitch between the stations is cancelled by increasing the speed of the transfer belt, although the transfer deviation at each station can be prevented, the elongation of each image occurs. However, since the elongation amount is about 0.5 mm or less for an image of about 400 mm (A3 size image), normally, there is no problem. If the elongation of such an amount arises a problem, the elongation may be eliminated in the following manner.

That is to say, the correction may be performed by gradually (successively) delaying the image forming timings (latent image forming timings in the electrophotographic system) of the image forming stations, without increasing the speed of the transfer belt (i.e., by maintaining $\delta=1$ in FIG. 3 regardless of any isothermal change).

Figure 4:
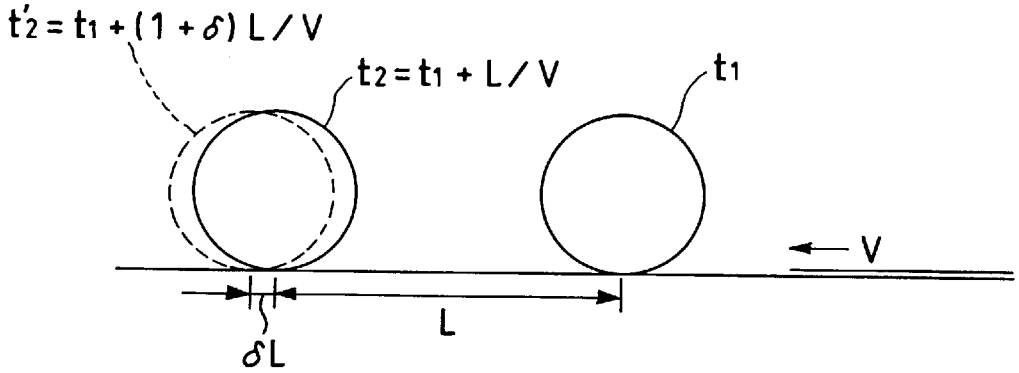
FIG. 4 is an explanatory view for explaining image formation timing control according to the first embodiment.

Now, such correction will be described concretely with reference to FIG. 4. It is assumed that the distance between two stations is L and the speed of the recording sheet is V. In order to overlap the images formed at two stations without any deviation, the image forming start timing $t_2$ of the second station is delayed by L/V in comparison with the image forming start timing $t_1$ of the first station (i.e., $t_2=t_1+L/V$). When the distance between the stations is increased by δ due to the temperature increase, by further delaying the image forming start timing $t_2$ of the second station by δL/V from $t_2$ (i.e., $t_2'=t_1+(1+\delta)L/V$), the transfer deviation can be prevented.

While an example that the change in speed due to the thermal expansion of the belt drive roller is corrected by changing the rotation number of the belt drive motor by feedback control was explained, only the image forming timings may be changed while maintaining the rotation number of the motor unchanged. That is to say, the change in speed of the transfer belt is guessed on the basis of the internal temperature information and the elongation ratio of the image is calculated based on the speed change. Then, in the formation of the image on the photosensitive drum, by expanding or contracting the image in correspondence to the elongation ratio (by changing the frequency in the latent image formation), the transfer deviation is cancelled in the transferring operation, to thereby obtain the proper image.

It should be understood that a further stable image can be formed not only by altering the belt speed and/or latent image forming timing but also by altering the process speed and/or process timing regarding the photosensitive drum (for example, speed of the photosensitive drum, development timing and speed, and first charge timing).

Incidentally, while the environment detection sensor 53 was used as a temperature sensor, if cost and space problems are permitted, a sensor for detecting the temperature of the belt drive roller itself may be provided to perform more correct control. Further, in case of the ink jet system or the heat transfer system, the image forming timing corresponds to a recording timing for recording an image on a recording medium from a recording head.

As mentioned above, according to the first embodiment, under all of the usage temperature conditions, since the convey speed of the transfer belt given by the belt drive roller can be kept constant regardless the change in the internal temperature, the expansion/contraction of the image and the transfer deviation in the superimposed images can be prevented, to thereby obtain a high quality image. Further, since any special mechanism(s) is not required to be added, the apparatus can be prevented from being complicated, bulky and expensive.

Second Embodiment

Next, a second embodiment of the present invention will be explained with reference to FIG. 5. In this second embodiment, the environment detection sensor in the first embodiment is omitted and any sensor for detecting the temperature of the belt drive roller itself is also not provided. Now, only the difference from the first embodiment will be described.

When the power source of the apparatus is turned ON, the rollers 41A, 41B of the fixing unit are heated to the predetermined temperature, and, thereafter, the temperature of the rollers is controlled to maintain to a constant level. A temperature sensor 46 (FIG. 1) is contacted with the roller 41B, and the above temperature control is performed on the basis of the detection signal from the sensor 46 (this sensor may be of type in which a resistance value of an element is changed in accordance with change in temperature).

Figure 5:
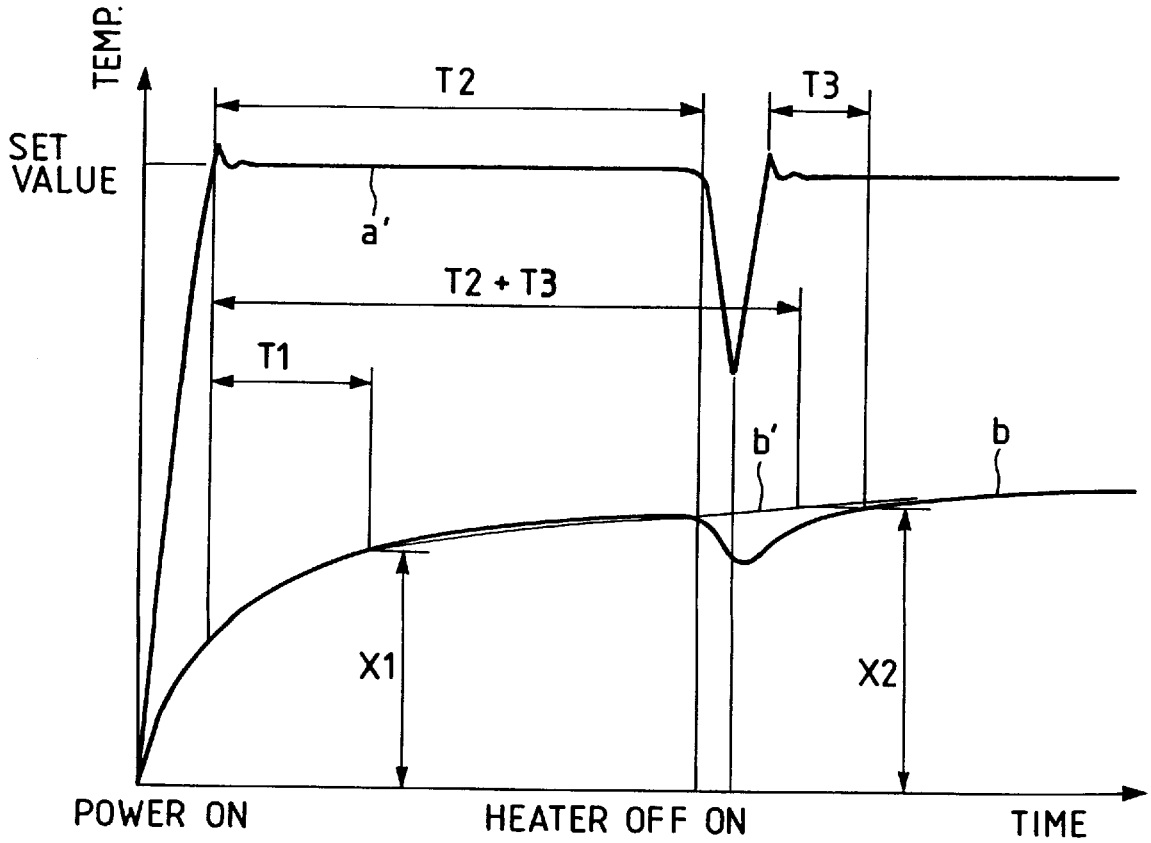
FIG. 5 is a graph showing change in temperatures of elements in an image forming apparatus according to a second embodiment of the present invention.
Figure 6:
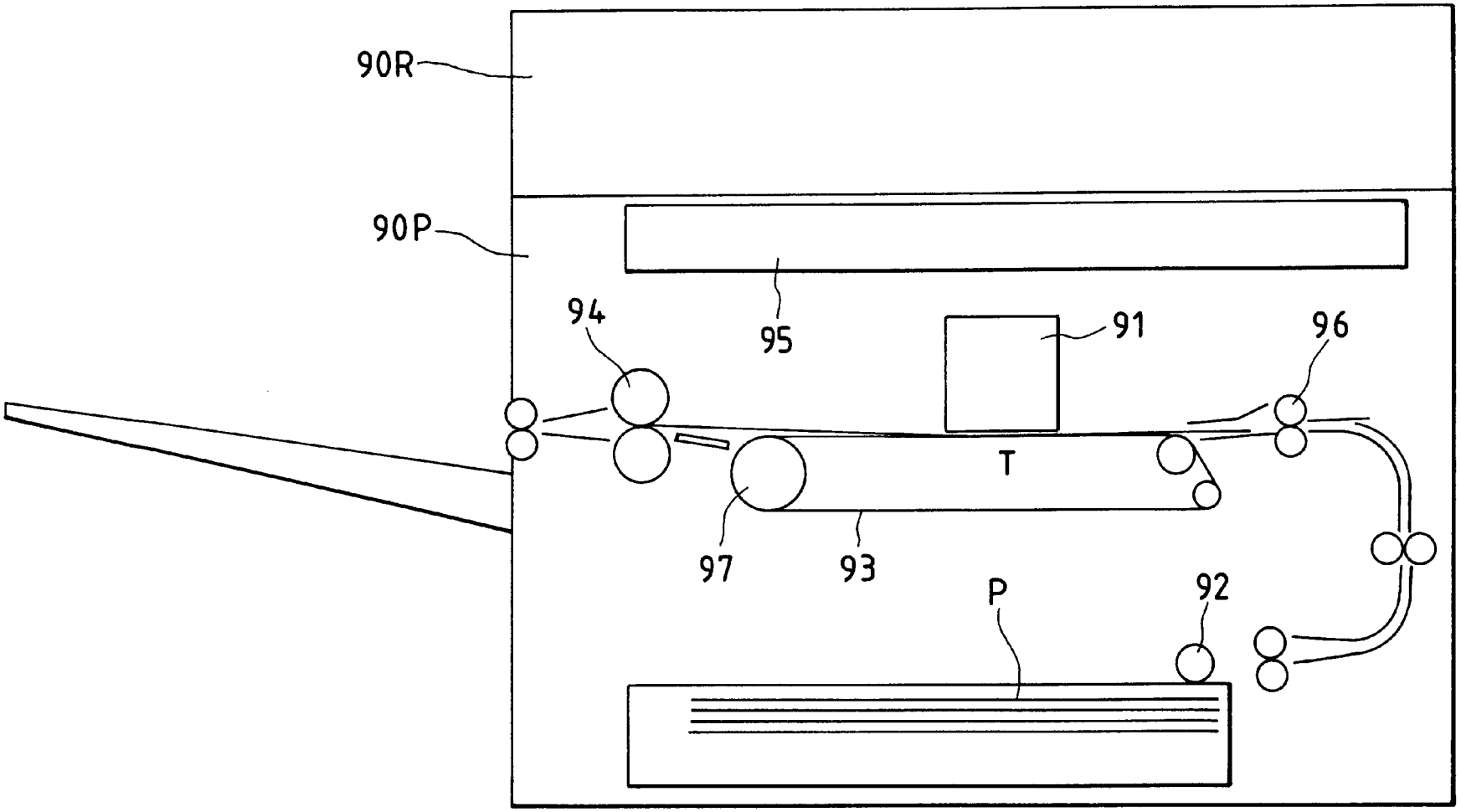
FIG. 6 is a schematic sectional view of a conventional image forming apparatus.
Figure 7:
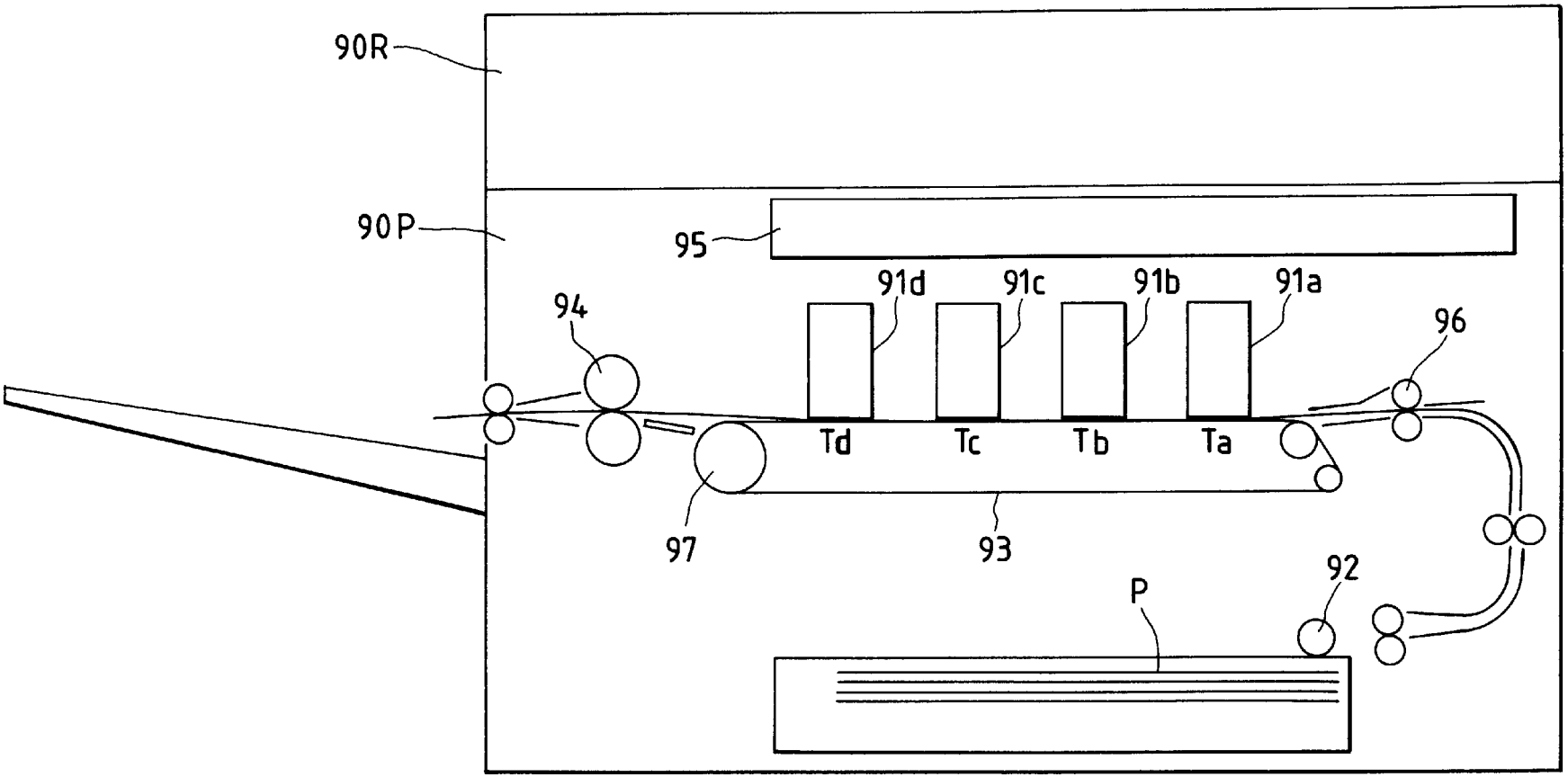
FIG. 7 is a schematic sectional view of another conventional image forming apparatus.

The change in temperature of the belt drive roller after power ON (heater ON) is previously measured, and, as shown by a thin line curve b' in FIG. 5, the measured data is stored as a correction table representing a relation between the measured temperature and a time. After power ON, a control device continues to monitor output data of the sensor (curve a'), and the time duration after set temperature is reached is measured. As a result, as shown in FIG. 5, for example, after time duration T1 is elapsed, it can be seen that the temperature of the belt drive roller is increased by X1.

After the heater is turned OFF due to abnormality such as occurrence of sheet jam, when the set temperature is restored again, correction data X2 (FIG. 5) after time duration (T2+T3) is elapsed can be used as the roller temperature. The fat line curve b indicates the actual roller temperature.

According to this method, since the temperature of the belt drive roller can be guessed by utilizing the fixing roller temperature sensor, any additional temperature sensor for the belt drive roller is not required.

Further, in an apparatus having good heat insulating ability so that the reduction of roller temperature does not almost occur even when the abnormality is generated, a relation between the roller temperature and the time duration after power ON is previously determined, and the actual roller temperature may be guessed on the basis of the determined data. In addition, the roller temperature may be guessed by a combination of the above methods.

What is claimed is:

1. An image forming apparatus comprising:

a recording material bearing member for bearing and conveying a recording material;

image forming means for forming an image which comprises plural color images sequentially superposed on top of each other on the recording material born on said recording material bearing member; and a drive rotary member for driving said recording material bearing member to convey the recording material;

wherein a rotational speed of said drive rotary member is controlled in accordance with information regarding a temperature of the image forming apparatus.

2. An image forming apparatus according to claim 1, wherein an image forming timing is controlled in accordance with the information regarding the temperature of the image forming apparatus.

3. An image forming apparatus according to claim 1, wherein said recording material bearing member is a dielectric belt, and said drive rotary member is a roller for supporting said dielectric belt.

4. An image forming apparatus according to claim 1 wherein said image forming means sequentially superposes said plural color images on top of each other on the recording material born on said recording material bearing member at a plurality of image forming portions.

5. An image forming apparatus according to claim 1, wherein said image forming means includes an image bearing member, and an image transfer means for transferring the image from said image bearing member onto the recording material born on said recording material bearing member.

6. An image forming apparatus according to claim 2, wherein said image forming means includes an image bearing member, latent image forming means for forming a latent image on said image bearing member, developing means for developing the latent image with toner, and image transfer means for transferring the image from said image bearing member onto the recording material born on said recording material bearing member, and further wherein the image forming timing is a latent image forming timing.

7. An image forming apparatus according to claim 5, wherein a shifting speed of said image bearing member can be changed corresponding to a change in a rotational speed of said drive rotary member.

8. An image forming apparatus according to claim 6, wherein a shifting speed of said image bearing member can be changed corresponding to a change in the image forming timing.

9. An image forming apparatus according to one of claims 1 to 8, further comprising fixing means for fixing the image onto the recording material by heat.

10. An image forming apparatus according to claim 1, further comprising a temperature sensor for detecting a temperature of an interior of the image forming apparatus.

11. An image forming apparatus according to claim 9, wherein the information regarding a temperature of the image forming apparatus includes at least one of a detection temperature detected by a temperature sensor disposed within the image forming apparatus, a time duration elapsed after a turn-on of power source of the image forming apparatus, and a temperature adjusting time for said fixing means.

12. An image forming apparatus according to claim 1, wherein said image forming means sequentially superposes the plural color images on top of each other on the recording material born on said recording material bearing member at predetermined time intervals.

13. An image forming apparatus according to claim 1, wherein said image forming means has a plurality of image bearing members on which latent images are sequentially formed at predetermined time intervals.

14. An image forming apparatus comprising:

a recording material bearing member for bearing and conveying a recording material; and image forming means for forming an image on the recording material born on said recording material bearing member;

wherein an image forming timing is controlled in accordance with information regarding a temperature of the image forming apparatus.

15. An image forming apparatus according to claim 14, wherein said recording material bearing member is a dielectric belt, and said drive rotary member is a roller for supporting said dielectric belt.

16. An image forming apparatus according to claim 14, wherein said recording material bearing member conveys the recording material to a plurality of image forming portions to form plural color images thereon.

17. An image forming apparatus according to claim 14, wherein said image forming means includes an image bearing member, and image transfer means for transferring the image from said image bearing member onto the recording material born on said recording material bearing member.

18. An image forming apparatus according to claim 14, wherein said image forming means includes an image bearing member, a latent image forming means for forming a latent image on said image bearing member, a developing means for developing the latent image with toner, and an image transfer means for transferring the image from said image bearing member onto the recording material born on said recording material bearing member, and further wherein the image forming timing is a latent image forming timing.

19. An image forming apparatus according to claim 17, wherein a shifting speed of said image bearing member can be changed corresponding to a change in a rotational speed of said drive rotary member.

20. An image forming apparatus according to claim 18, wherein a shifting speed of said image bearing member can be changed corresponding to a change in the image forming timing.

21. An image forming apparatus according to one of claims 14 to 20, further comprising fixing means for fixing the image onto the recording material by heat.

22. An image forming apparatus according to claim 14, further comprising a temperature sensor for detecting a temperature of an interior of the image forming apparatus.

23. An image forming apparatus according to claim 21, wherein the information regarding a temperature of the image forming apparatus includes at least one of a detection temperature detected by a temperature sensor disposed within the image forming apparatus, a time duration elapsed after a turn-on of power source of the image forming apparatus, and a temperature adjusting time for said fixing means.

24. An image forming apparatus according to claim 14, wherein said image forming means has a rotatable image bearing member, and a latent image to be formed on said rotatable image bearing member is extended and shortened in a rotational direction of said rotatable image bearing member in accordance with the information regarding said temperature.

* * * * *

UNITED STATES PATENT AND TRADEMARK OFFICE

CERTIFICATE OF CORRECTION

PATENT NO. : 5,907,741

DATED : May 25, 1999

INVENTOR(S) : KUNIHIKO MATSUZAWA, ET AL.

It is certified that error appears in the above-identified patent and that said Letters Patent is hereby corrected as shown below:

Title page,

ABSTRACT [57]

Line 5, "bewaring" should read --bearing--.

COLUMN 1

Line 24, "convey" should read --conveying--.
Line 35, "synchronous" should read --synchronism--.
Line 48, "proximity" should read --in proximity--.

COLUMN 5

Line 16, "synchronous" should read --synchronism--.
Line 26, "synchronous" should read --synchronism--.
Line 42, "process" should read --processes--.

COLUMN 6

Line 8, "conditions." should read --condition--.

UNITED STATES PATENT AND TRADEMARK OFFICE

CERTIFICATE OF CORRECTION

PATENT NO. : 5,907,741

DATED : May 25, 1999

INVENTOR(S) : KUNIHIKO MATSUZAWA, ET AL.

It is certified that error appears in the above-identified patent and that said Letters Patent is hereby corrected as shown below:

COLUMN 7

Line 32, "arises" should read --raises--.

Signed and Sealed this

Twenty-fifth Day of January, 2000

*Attest:*

*Attesting Officer*

*Acting Commissioner of Patents and Trademarks*